United States Patent [19]

Yamanashi et al.

[11] Patent Number: 4,701,662

[45] Date of Patent: Oct. 20, 1987

[54] SPARK PLUG CONNECTING STRUCTURE

[75] Inventors: Hidenori Yamanashi; Toshio Inada; Seiichi Wakabayashi, all of Gotenba, Japan

[73] Assignee: Yazaki Corporation, Tokyo, Japan

[21] Appl. No.: 871,277

[22] Filed: Jun. 6, 1986

[30] Foreign Application Priority Data

Jun. 12, 1985 [JP] Japan ..... 60-087621[U]

[51] Int. Cl.[4] ..... H01T 13/04

[52] U.S. Cl. ..... 313/51; 313/135

[58] Field of Search ..... 313/51, 135; 123/169 R

[56] References Cited

U.S. PATENT DOCUMENTS 3,002,126 9/1961 Noir ..... 313/51 X

*Primary Examiner*—David K. Moore
*Assistant Examiner*—Sandra L. O'Shea
*Attorney, Agent, or Firm*—Murray and Whisenhunt

[57] ABSTRACT

A spark plug having a porcelain insulator affixed with a bushing of a rubber, an oil-impregnated rubber or a thermosetting elastomer such as a silicone resin. The spark plug is connected to an ignition system by a spark plug connecting structure including a plug terminal attached to the extremity of a high-tension resistance cord so as to seize the electrode of the spark plug, and a plug cap covering the free end portion of the high-tension resistance cord and, the plug terminal. In connecting the spark plug to the ignition system, the plug cap is fitted tightly over the bushing so that the porcelain insulator and the electrode of the spark plug, and the plug terminal are sealed perfectly.

1 Claim, 6 Drawing Figures

SPARK PLUG CONNECTING STRUCTURE

BACKGROUND OF THE INVENTION

The present invention relates generally to a spark plug and, more specifically, to a spark plug connecting structure of high insulating capacity, including the constitution of the connecting head of a spark plug and that of a plug cap.

A conventional spark plug and a spark plug connecting structure for connecting the spark plug and a high-tension resistance cord are shown in FIG. 6.

This conventional spark plug 1 has an electrode 3 and a porcelain insulator 2 keeping the electrode 3 from grounding through the engine. The spark plug connecting structure comprises a plug terminal 5 fixed to the extremity of high-tension resistance cord 4 so as to seize the electrode 3 of the spark plug 1, and a plug cap 6 covering the porcelain insulator 2, the plug terminal 5 and the free end portion of the high-tension resistance cord 4. A mold lubricant film 7 is formed between the inner surface of the plug cap 6 and the outer surface of the porcelain insulator 2 to prevent the plug cap 6 from sticking to the porcelain insulator 2 under the influence of heat.

A high voltage is applied to the plug terminal 5 and the electrode 3 of the spark plug 1 through the high-tension resistance cord 4 connected directly to or through a distributor to an ignition coil. The major part of the electrode is insulated by the porcelain insulator 2 and the plug cap 6. The recent development of internal-combustion engines has a general tendency to raise the compression ratio and to provide the internal-combustion engine with a turbosupercharger requiring increased voltage to be applied to the spark plug. Under such circumstances, the conventional spark plug and the spark plug connecting structure are not satisfactory in the sealing characteristics over the sealing length s of the porcelain insulator 2 and the plug cap 6. Furthermore, the mold lubricant film 7 formed between the plug cap 6 and the porcelain insulator 2 to prevent the plug cap 6 from sticking to the porcelain insulator 2 due to heat is liable to deteriorate the sealing effect of the plug cap 6.

SUMMARY OF THE INVENTION

Accordingly, it is an object of the present invention to provide a spark plug eliminated of the above-mentioned disadvantages of the conventional spark plug and capable of being connected to a high-tension resistance cord with a spark plug connecting structure.

In order to achieve the object of the invention, the present invention provides a spark plug having a bushing made of a thermosetting elastomer, including a silicone resin, an oil-impregnated rubber or a rubber which covers the porcelain insulator of the spark plug and has a positioning flange at one open end thereof for positioning the bushing correctly relative to a plug cap.

The spark plug connecting structure comprises the bushing covering the porcelain insulator of the spark plug, and a conventional connector comprising a plug terminal fixed to the extremity of a high-tension resistance cord so as to seize the electrode of the spark plug, and a plug cap covering the plug terminal and the free end portion of the high-tension resistance cord and closely fitted over the bushing attached around the porcelain insulator of the spark plug.

Formed of a rubber, an oil-impregnated rubber or a thermosetting elastomer such as a silicone resin, the bushing is able to cover the porcelain insulator closely and the rubber plug cap can be fitted tightly over the bushing, and thereby the sealing of the porcelain insulator is improved remarkably.

Accordingly, the insulation of the electrode and the plug terminal from grounding is enhanced greatly over the entire sealing length by the improved sealing engagements of the bushing with the porcelain insulator.

Furthermore, when the bushing is made of an oil-impregnated rubber, a lubricant film 19 is formed over the outer surface of the bushing, which improves the sealing engagement of the bushing and the plug cap, and serves to smooth fitting of the plug cap over the bushing.

The above and other object, features and advantages of the present invention will become more apparent from the following description of the preferred embodiments taken in conjunction with the accompanying drawings.

DESCRIPTION OF THE PREFERRED EMBODIMENTS

Figure 1:
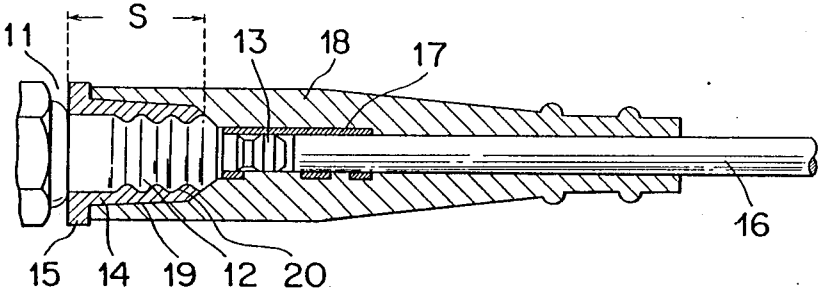
FIG. 1 is a longitudinal sectional view of a spark plug, in a first embodiment, according to the present invention and a spark plug connecting structure for connecting the spark plug to a high-tension resistance cord.

Referring to FIG. 1, a spark plug 11 according to the present invention has a bushing 14 made of a thermosetting elastomer such as a heat-resistant EPDM, a silicone rubber, an oil-impregnated rubber or a silicone resin. The bushing 14 may be affixed to the spark plug 11 by insert molding or may be molded individually and then attached adhesively with an adhesive to the porcelain insulator 12 of the spark plug 11. When the bushing 14 is made of a material other than an oil-impregnated rubber, a silicone oil or a silicone grease is applied over the outer surface of the bushing 14 to form a lubricant film 19 over the outer surface thereof to enhance the sealing effect of a plug cap 18. A flange 15 is formed at the inner end of the bushing 14 to locate the plug cap 18 correctly relative to the spark plug 11. The bushing 14, the plug cap 18 and a plug terminal 17 attached to the extremity of a high-tension resistance cord 16 so as to seize the electrode 13 of the spark plug constitute a spark plug connecting structure.

Figure 2:
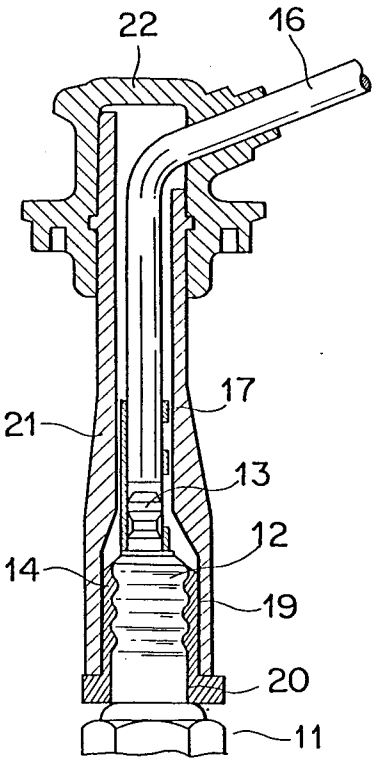
FIG. 2 is a longitudinal sectional view of the spark plug of FIG. 1 and another spark plug connecting structure.

FIG. 2 illustrates another spark plug connecting structure of the present invention, which comprises the bushing 14 fixedly attached to the porcelain insulator 12 of the spark plug 11, a plug cap 21 made of a hard plastic, a plug terminal 17 attached to the extremity of a high-tension resistance cord 16 so as to seize the electrode 13 of the spark plug 11, and a rain cover 22 attached to the upper end, as viewed in FIG. 2, of the plug cap 21. The plug cap 21 is designed so as to be fitted tightly over the bushing 14 for effective insulation.

The spark plugs of the present invention were subjected to surface insulation breakdown strength test in comparision with conventional spark plugs.

Figure 3:
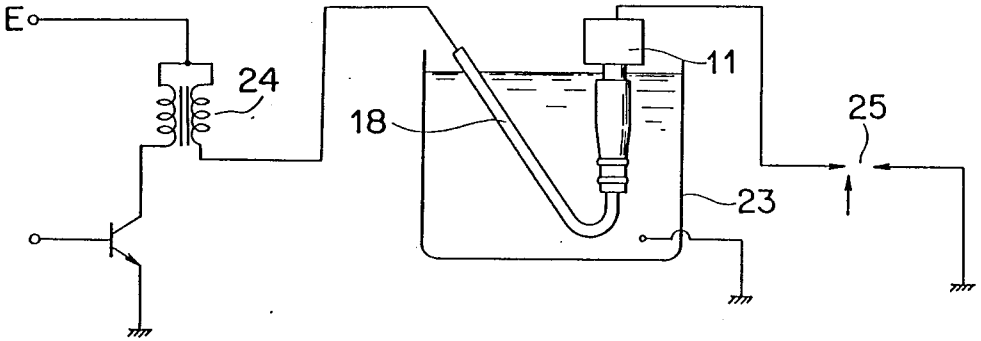
FIG. 3 is a diagrammatic illustration of assistance in explaining an apparatus for measuring the surface insulation breakdown strength of spark plugs.

FIG. 3 shows an insulation testing apparatus for testing the surface breakdown strength of a spark plug and the associated spark plug connecting structure. The junction of a spark plug 11 and a high-tension resistance cord 18 was immersed in a 5% salt solution contained in a grounded container 23, the high-tension resistance cord 18 was connected through a coil 24 to a power source E(14 V dc.) and the spark plug 11 was grounded through a three -needle gap 25. The respective surface breakdown strengths of combinations of spark plugs of the present invention and the relevant spark plug connecting structures and combinations of conventional spark plugs and the relevant spark plug connecting structures were measured.

Figure 4:
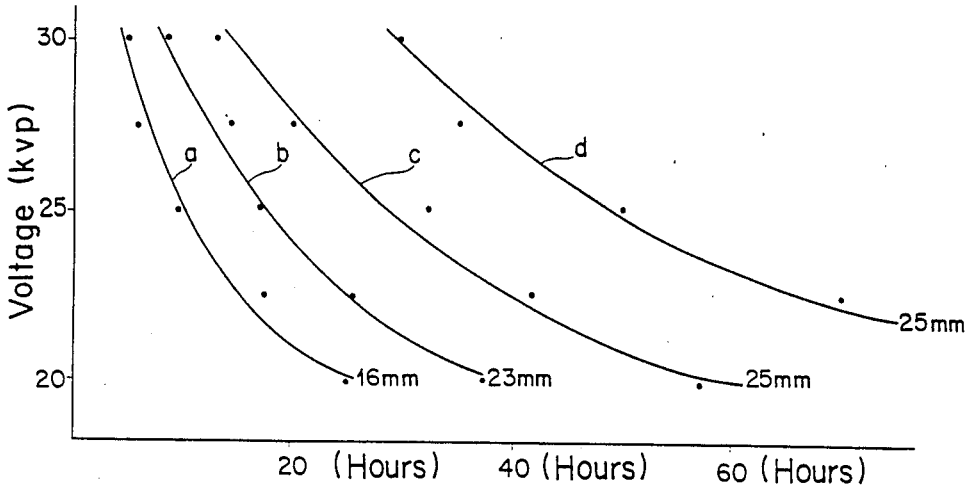
FIGS. 4 and 5 are graphs comparatively showing the respective surface insulation breakdown strengths of the spark plug of the present invention and conventional spark plugs.
Figure 5:
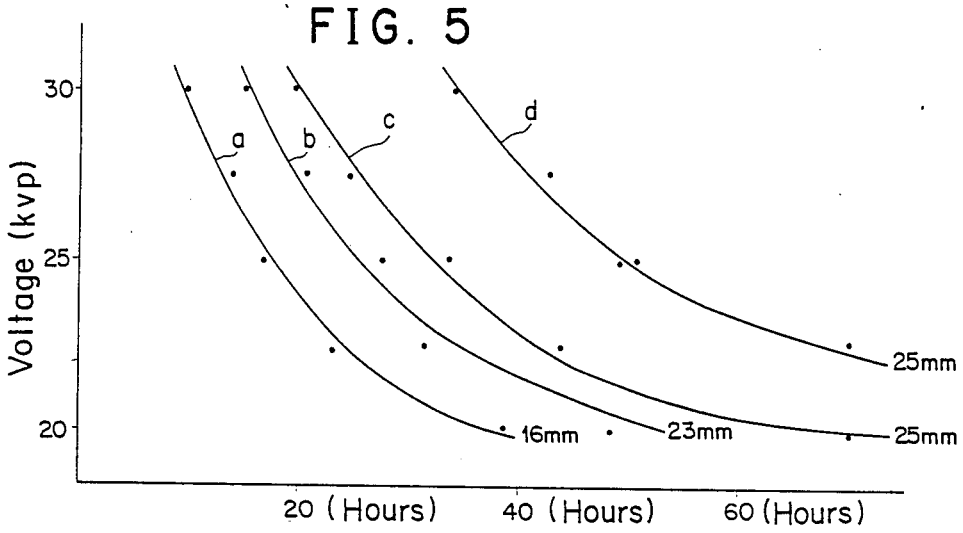
Figure 6:
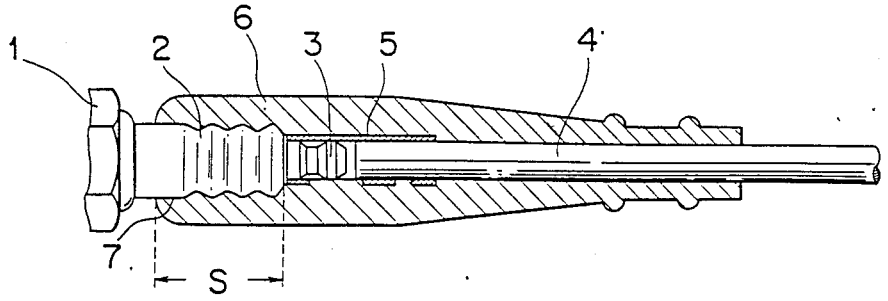
FIG. 6 PRIOR ART
FIG. 6 is a longitudinal sectional view of a conventional spark plug and the associated spark plug connecting structure.

The results of the surface breakdown strength tests are shown in FIGS. 4 and 5. In FIG. 4, curves a, b and c represent the surface insulation breakdown strengths of conventional spark plug connecting structures having sealing lengths s of 16 mm, 23 mm and 25 mm, respectively, and a curve d represents the surface insulation breakdown strength of the spark plug connecting structure of the present invention having sealing length of 25 mm. In FIG. 5, curves a, b and c represent the surface insulation breakdown strengths of conventional spark plugs combined with conventional spark plug connecting structures each including a plug cap made of an oil-impregnated silicon rubber, respectively, and a curve d represents the surface insulation breakdown strength of a spark plug of the present invention provided with a bushing made of an oil-impregnated silicone rubber, and combined with a spark plug connecting structure including a plug cap made of a silicone rubber.

As in apparent from FIGS. 4 and 5, the peak voltage (kvp) required to cause surface insulation breakdown has a tendency to decline as the engine operation continues, for 20 hours to 40 hours and further 60 hours. However, a higher voltage is needed if the sealing length s is increased from 16 mm to 25 mm as seen from curves a, b and c; that is; the surface insulation breakdown strength is enhanced. With the spark plug connecting structure of the present invention, said surface insulation breakdown strength is further increased as seen from curve d even if the sealing length s is not increased.

Thus, the spark plug of the present invention is highly effectively insulated and is capable of application to internal-combustion engines of high compression ratio.

Although the invention has been described in its preferred form with a certain degree of particularity, it is to be understood that many changes and variations are possible in the invention without departing from the scope and spirit thereof.

What is claimed is:

1. A spark plug connecting structure which comprises:

a spark plug having an electrode extending longitudinally thereof, said electrode having an end portion;

a porcelain insulator disposed about and fixed to said electrode and extending longitudinally therealong such that said end portion of the electrode projects from the insulator;

a bushing disposed about said porcelain insulator and sealingly fixed thereto, said bushing extending longitudinally substantially coextensively with said porcelain insulator, said bushing made of a member selected from the group consisting of a rubber, an oil-impregnated rubber and a thermosetting elastomer;

a high tension resistance cord having an end;

a plug terminal connected to said end of said high tension resistance cord, said plug terminal releasably engageable of said end portion of said electrode;

a plug cap sealingly disposed about said high tension resistance cord proximate said end of said cord, said plug cap covering said plug terminal and being releasably sealingly engageable with said bushing over the longitudinal extent of said bushing.

* * * * *